US005890945A

United States Patent [19]

Asami et al.

[11] Patent Number: 5,890,945

[45] Date of Patent: Apr. 6, 1999

[54] TOY HAVING A MOVING PIECE CAPABLE OF SWINGING MOVEMENT ALONG A SUSPENDING TRACK MEMBER

[75] Inventors: Asayoshi Asami, Kanagawa Kan; Akiharu Matsui, Tokyo, both of Japan

[73] Assignee: Dah Yang Toy Industrial Co., Ltd., Tainan, Taiwan

[21] Appl. No.: 997,601

[22] Filed: Dec. 23, 1997

[51] Int. Cl.[6] ..... A63H 21/02; A63H 15/02

[52] U.S. Cl. ..... 446/228; 446/316

[58] Field of Search ..... 446/228, 229, 446/166, 167, 168, 169, 170, 171, 172, 173, 174, 316, 330, 332, 444, 445

[56] References Cited

U.S. PATENT DOCUMENTS

| | | | |
|---|---|---|---|
| 1,538,217 | 5/1925 | Sears | 446/228 |
| 1,641,477 | 9/1927 | Esser | 446/229 |
| 2,219,831 | 10/1940 | Winter | 446/228 |
| 2,618,895 | 11/1952 | Sidney | 446/316 X |
| 4,068,402 | 1/1978 | Tanaka | 446/445 |
| 4,128,964 | 12/1978 | Ogasawara | 446/171 |
| 4,708,685 | 11/1987 | Udagawa | 446/171 X |
| 5,279,871 | 1/1994 | Segan et al. | 446/171 X |

*Primary Examiner*—Robert A. Hafer
*Assistant Examiner*—D Neal Muir
*Attorney, Agent, or Firm*—Darby & Darby

[57] ABSTRACT

A toy includes a base with an upright post, a suspending track member and a moving piece. The suspending track member is mounted on the prop and has a track portion that inclines gradually and downwardly and that has a top side formed with an anti-slipping surface. The moving piece is capable of downward sliding movement along the track portion and includes a body part and left and right arms, each of which has a lower section pivoted to the body part for forward and rearward pivoting movement of the left and right arms relative to the body part, and an upper section that extends from the lower section. The upper sections of the left and right arms are spaced apart by a distance wider than width of the track portion such that the left and right arms can be disposed on left and right sides of the track portion. The upper section of each of the left and right arms is formed with a track contacting part that extends above the track portion for contacting the anti-slipping surface and for suspending the moving piece on the track portion.

10 Claims, 6 Drawing Sheets

TOY HAVING A MOVING PIECE CAPABLE OF SWINGING MOVEMENT ALONG A SUSPENDING TRACK MEMBER

BACKGROUND OF THE INVENTION

1. Field of the Invention

The present invention relates to a toy, more particularly to a toy which has a moving piece with upwardly extending arms, and a suspending track member that has the arms of the moving piece hanging therefrom and that is formed with an anti-slipping surface to reduce downward moving speed of the moving piece and to result in intermittent and alternating stopping of the arms of the moving piece so as to give an effect of swinging movement of the moving piece along the track member.

2. Description of the Related Art

There are various types of toys having track members and moving pieces that are movable along the track members. In one example of a conventional toy, movement of a moving piece from a lower position to an upper position of a track member is effected by a magnet. The moving piece slides downwardly along the track member to return to the lower position in preparation for a succeeding cycle. In another example of a conventional toy, the moving piece is brought from a lower position to an upper position of a track member by means of a drive chain. The moving piece then slides downwardly along the track member to return to the lower position for the next cycle. In still other examples of conventional toys, gears or linear drive means are employed to move a moving piece from a lower position to an upper position of a track member to enable the moving piece to slide downwardly along the track member.

Although the method and mechanism employed for moving a moving piece from a lower position to an upper position of a track member may differ according to the type of toy, the moving piece usually slides downwardly along the track member with the aid of rollers to return to the lower position for the next cycle. After being popular for years, the aforementioned types of toys have lost their appear and have become less attractive to consumers.

SUMMARY OF THE INVENTION

The main object of the present invention is to provide a toy which has a moving piece movable on a suspending track member to give an effect of swinging movement of the moving piece along the track member.

Accordingly, the toy of the present invention includes a base, a suspending track member and a moving piece. The base is provided with an upright prop. The suspending track member is mounted on the prop, and has a track portion that inclines gradually and downwardly and that has a top side formed with an anti-slipping surface. The moving piece is capable of downward sliding movement along the track portion, and includes a body part and left and right arms. Each of the arms has a lower section pivoted to the body part for forward and rearward pivoting movement of the arms relative to the body part, and an upper section that extends from the lower section. The upper sections of the left and right arms are spaced apart by a distance wider than width of the track portion such that the arms can be disposed on left and right sides of the track portion. The upper section of each of the left and right arms is formed with a track contacting part that extends above the track portion for contacting the anti-slipping surface and for suspending the moving piece on the track portion. The anti-slipping surface on the track portion generates friction with the track contacting parts of the left and right arms as the moving piece slides downwardly along the track portion to reduce downward moving speed of the left and right arms along the track portion and to result in intermittent and alternating stopping of the left and right arms relative to the track portion, thereby causing the left and right arms to pivot relative to the body part in an alternating fashion to give an effect of swinging movement of the moving piece along the track portion.

BRIEF DESCRIPTION OF THE DRAWINGS

Other features and advantages of the present invention will become apparent in the following detailed description of the preferred embodiment with reference to the accompanying drawings, in which.

DETAILED DESCRIPTION OF THE PREFERRED EMBODIMENT

Figure 1:
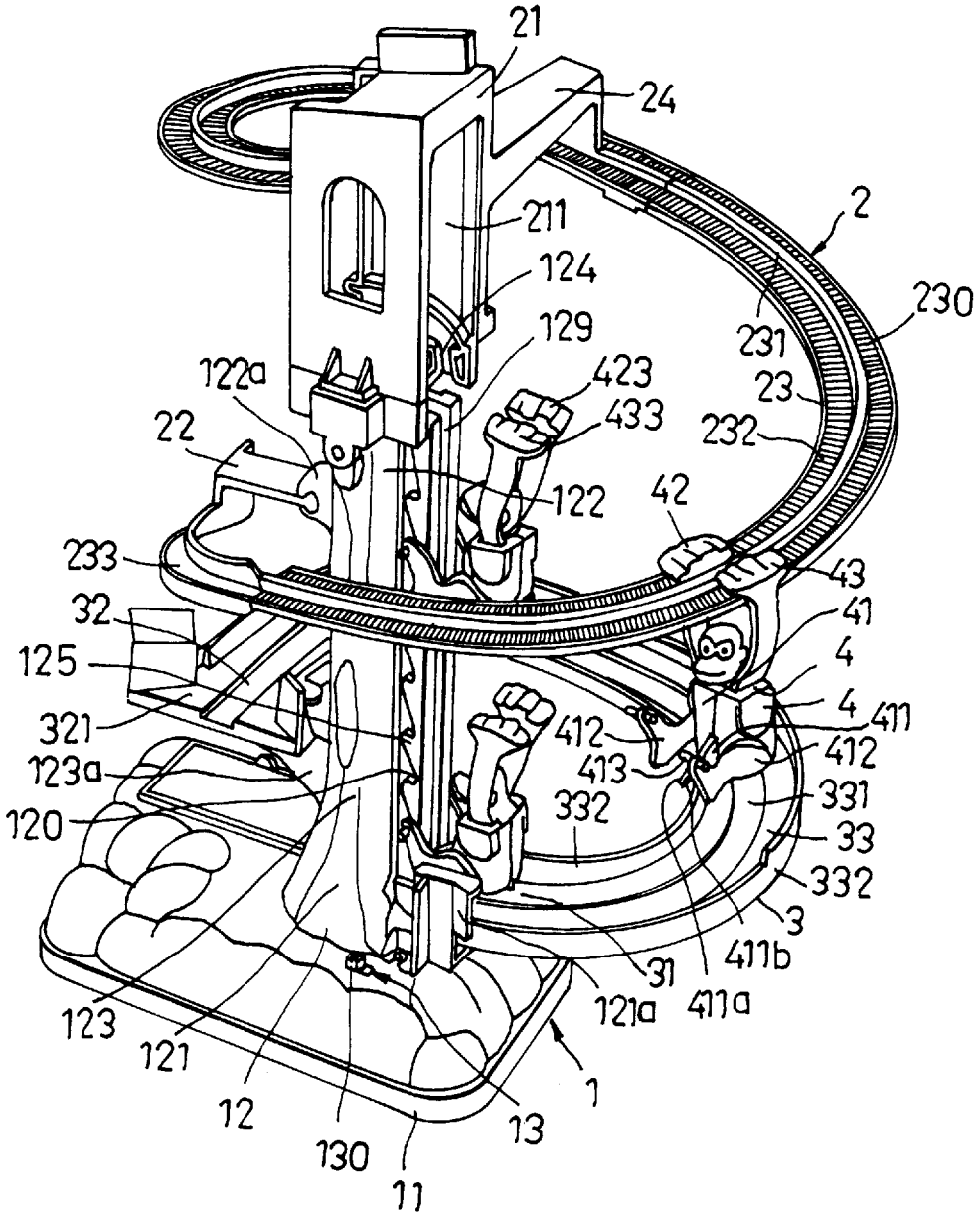
FIG. 1 is a perspective view of a preferred embodiment of a toy according to the present invention.

Referring to FIG. 1, the preferred embodiment of a toy of the present invention is shown to include a base 1, a suspending track member 2, a sliding track member 3 and a plurality of moving pieces 4.

The base 1 has a bottom housing 11 adapted to be placed on a flat surface, and an upright prop 12 mounted on the housing 11. The prop 12 has an upper first section 124, a second section 122 disposed below the first section 124, a third section 123 disposed below the second section 122, and a fourth section 121 disposed below the third section 123 and connected to the bottom housing 11. The second section 122 has an upper mounting projection 122*a* which projects transversely from a left side thereof. The third section 123 has a lower mounting projection 123*a* which projects transversely from a left side thereof. The fourth section 121 has a pair of mounting plates 121*a* which project transversely from a right side thereof. The first section 124 has a substantially planar top surface 124a (see FIG. 6).

The prop 12 is formed with a longitudinally extending groove 129 on the right side thereof. The prop 12 further has front and rear sides with outer surfaces formed with guide teeth 125 therealong. Two adjacent guide teeth 125 form a retaining notch 120 therebetween.

Figure 2:
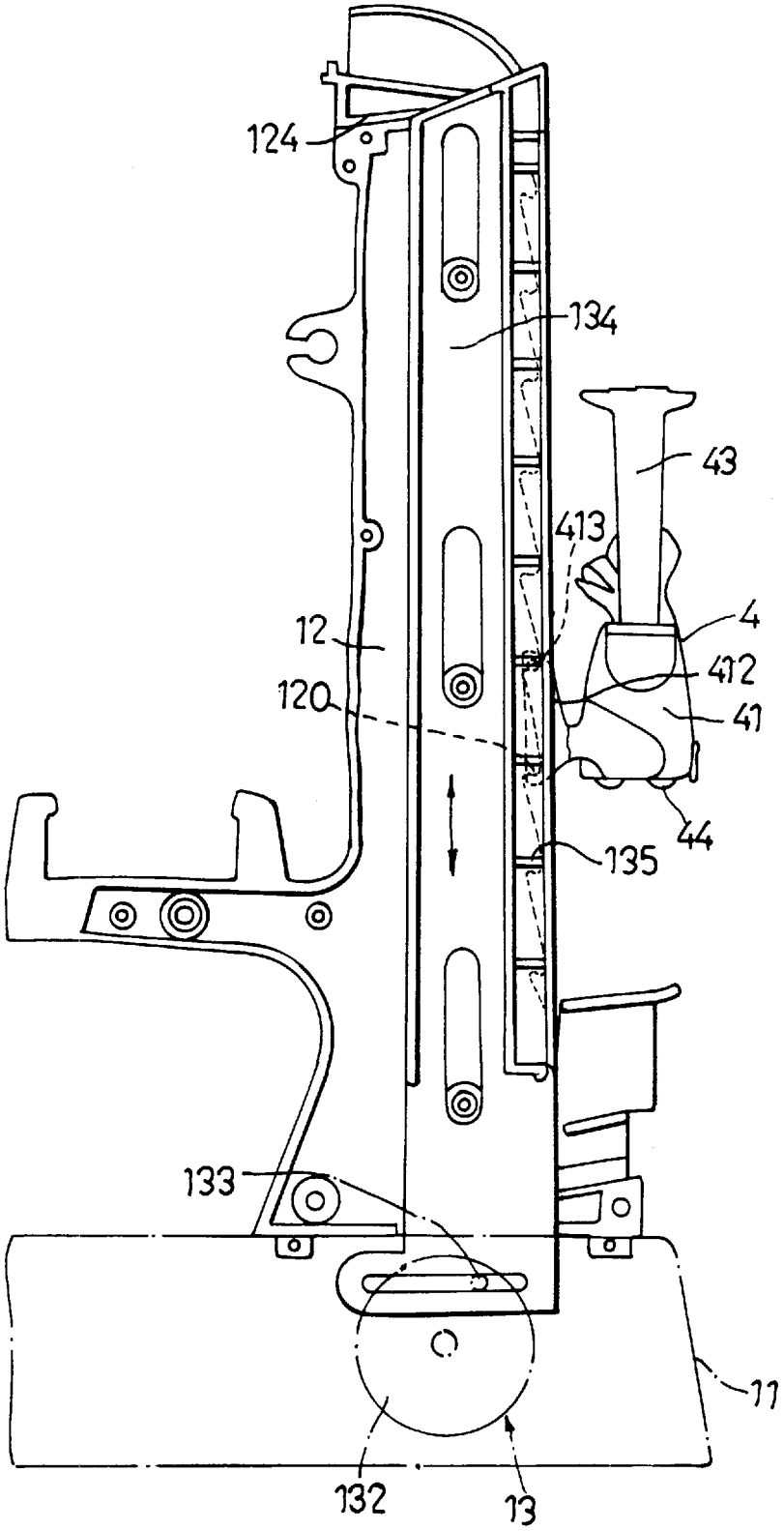
FIG. 2 is a schematic side view illustrating a moving mechanism of the toy of the preferred embodiment for moving a moving piece upwardly along a prop.

Referring to FIGS. 1 and 2, an elongated drive plate 134 is disposed in the groove 129 and is movable upwardly and downwardly therein. The drive plate 134 is formed with a plurality of vertically spaced, horizontal rung projections 135 that project toward the right side of the prop 12. Motor drive means 13 is provided on the base 1 for driving the drive plate 134 upward and downward, and includes a rotary plate 132 mounted within the bottom housing 11 and provided with an eccentric pin 133 which is coupled to a lower end of the drive plate 134. Rotation of the rotary plate 132 results in reciprocating linear movement of the drive plate 134 in the groove 129. A switch member 130 that is electrically connected to the motor drive means 13 is provided on the bottom housing 11 to permit activation and deactivation of the motor drive means 13.

The suspending track member 2 is mounted on the prop 12 and extends around the same. The suspending track member 2 has a first mounting portion 21 which is formed as a rectangular frame and which is mounted on the first section 124 above the top surface 124*a* (see FIG. 6) to confine a passage space 211 with the top surface 124*a*. The suspending track member 2 further has a second mounting portion 22 mounted on the upper mounting projection 122*a* of the second section 122 of the prop 12, and a track portion 23 disposed between the first and second mounting portions 21, 22. As shown, the track portion 23 inclines gradually and downwardly and curves around the prop 12. A bracket 24 extends between the first mounting portion 21 and the track portion 23 to result in enhanced stability of the suspending track member 2 on the prop 12. The track portion 23 is formed with a middle partition rib 231 extending along the length thereof. The track portion 23 has a top side formed with a plurality of equally-spaced elongated grooves 232 on two opposite sides of the middle partition rib 231. The elongated grooves 232 extend along the width of the track portion 23 perpendicular to the partition rib 231 to form an anti-slipping surface 230 on the track portion 23. In the present embodiment, the track portion 23 has a transfer section 233 adjacent to the second mounting portion 22 and provided with a smooth top surface.

The slide track member 3 is mounted on the prop 12 below the suspending track member 2. The slide track member 3 inclines gradually and downwardly and curves around the prop 12. The slide track member 3 has an entrance portion 32 mounted on the lower mounting projection 123*a* of the third section 123 of the prop 12, an exit portion 31 mounted on the fourth section 121 of the prop 12 and extending between the mounting plates 121*a*, and a slide portion 33 between the entrance portion 32 and the exit portion 31. The entrance portion 32 is disposed below the second mounting portion 22 of the suspending track member 2 and has a diverging entrance 321. The diverging entrance 321 is disposed below the transfer section 233 of the track portion 23 of the suspending track portion 2. The slide portion 31 has a smooth top surface 331 and two longitudinal edges formed respectively with guard plates 332.

Figure 3:
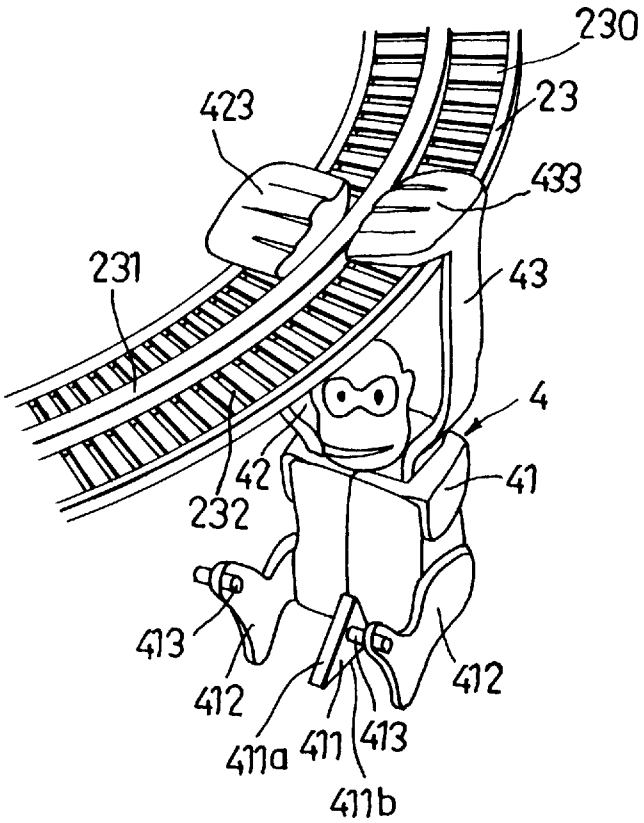
FIGS. 3 and 4 illustrate the moving piece when sliding downwardly along a suspending track member of the preferred embodiment.
Figure 5:
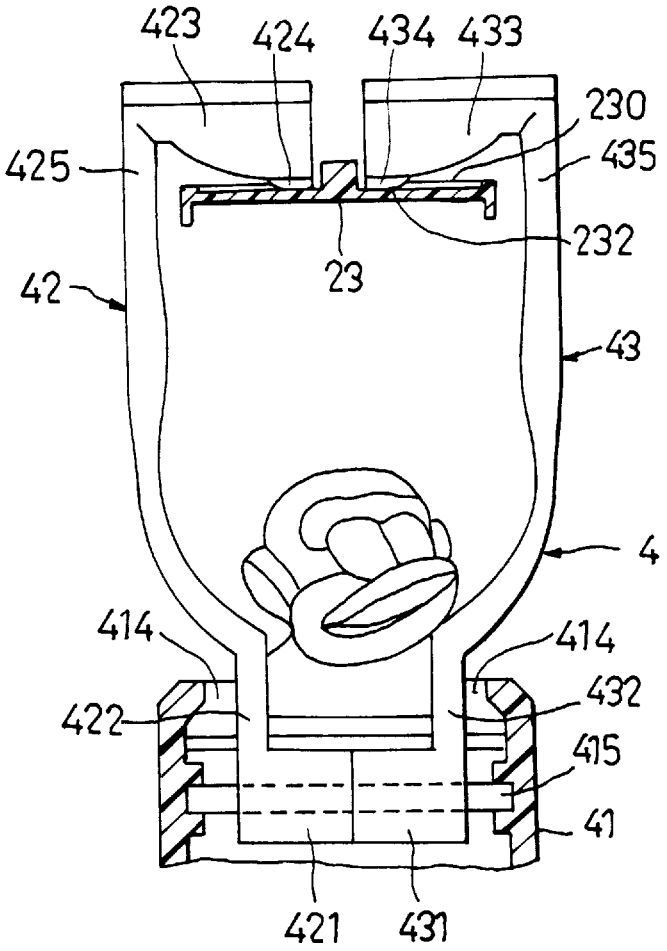
FIG. 5 is a vertical sectional view illustrating the moving piece of the preferred embodiment.

In this embodiment, the moving pieces 4 have appearances in the form of monkeys and are capable of downward sliding movement along the track portion 23 of the suspending track member 2 and along the slide portion 33 of the slide track member 3. Referring to FIGS. 3 and 5, each of the moving pieces 4 has a body part 41 and left and right arms 43, 42 extending upwardly from the body part 41. The body part 41 is hollow and has a horizontal pivot shaft 415 mounted therein. The body part 41 further has a top wall formed with a pair of openings 414. Each of the left and right arms 43, 42 has a lower section 432, 422 extending into the body part 41 via a respective one of the openings 414 and formed with a pivot tube 431, 421 which is sleeved rotatably on the pivot shaft 415 for mounting the left and right arms 43, 42 pivotally to the pivot shaft 415 and for permitting forward and rearward pivoting movement of the left and right arms 43, 42 relative to the body part 41. The openings 414 limit range of forward and rearward pivoting movement of the left and right arms 43, 42. The left and right arms 43, 42 further have upper sections 435, 425 that extend from the lower sections 432, 422 and that are spaced apart by a distance wider than the width of the track portion 23 of the suspending track member 2 such that the left and right arms 43, 42 can be disposed on left and right sides of the track portion 23. The upper section 435, 425 of each of the left and right arms 43, 42 is formed with a track contacting part 433, 423 that extends above the track portion 23 of the suspending track member 2 for contacting the anti-slipping surface 230 and for suspending the moving piece 4 on the track portion 23. The track contacting part 433, 423 of each of the left and right arms 43, 42 is formed with a downward projection 434, 424 for releasable engagement with the elongated grooves 232. The body part 41 of the moving piece 4 is provided with a wedge projection 411 which projects forwardly and which is extendible into the groove 129 of the prop 12. The wedge projection 411 has an inclined upper edge 411*a* and a substantially horizontal lower edge 411*b*. The moving piece 4 further has two opposite leg portions 412 which extend forwardly and respectively from left and right sides of the body part 41. Each of the leg portions 412 is formed with a horizontal, inward engaging pin 413 for engaging the retaining notches 120 of the prop 12. The body part 41 of the moving piece 4 has a bottom side provided with two rollers 44 (see FIG. 2) for rolling contact with the smooth top surface 331 of the slide track member 3 to facilitate sliding of the moving piece 4 along the slide track portion 3.

Referring to FIG. 1, assembly of the present embodiment is conducted as follows: The first and second mounting portions 21, 22 of the suspending track member 2 are mounted respectively on top of the first section 124 and the upper mounting projection 122*a* of the second section 122 of the prop 12 so that the suspending track member 2 curves downwardly around the prop 12. The entrance portion 32 and the exit portion 31 of the slide track member 3 are mounted respectively on the lower mounting projection 123*a* of the third section 123 and the fourth section 121 of the prop 12. After the track members 2, 3 have been mounted on the prop 12, the moving pieces 4 can be placed on the slide portion 33 of the slide track member 3 to permit downward sliding movement thereof along the slide track member 3.

Referring to FIGS. 1 and 2, when one of the moving piece 4 slides along the sliding track member 3 and reaches the exit portion 31, the wedge projection 411 of the moving piece 4 extends into the groove 129 of the prop 12 and extends between adjacent upper and lower ones of the rung projections 135. Each of the engaging pins 413 on the moving piece 4 extends into a lowermost one of the retaining notches 120 on a respective one of the front and rear sides of the prop 12. At this time, the switch member 130 is turned on by the user to activate the motor drive means 13 to result in upward and downward movement of the drive plate 134 within the groove 129. Upward movement of the drive plate 134 causes the lower one of the rung projections 135 to support the lower edge 411*b* of the wedge projection 411 of the moving piece 4 thereon so as to move the moving piece 4 upwardly with the drive plate 134 relative to the prop 12. Upward movement of the moving piece 4 with the drive plate 134 causes the engaging pins 413 to disengage the lowermost pair of retaining notches 120 for movement to an upper pair of the retaining notches 120. Downward movement of the drive plate 134 causes the upper one of the rung projections 135 to slide past the inclined upper edge 411*a* of the wedge projection 411 such that the moving piece 4 is pushed in a direction away from the prop 12 and toward the right side of the prop 12 to result in engagement between the engaging pins 413 and the upper retaining notches 120. The moving piece 4 is thus retained releasably on the prop 12 and is prevented from downward movement with the drive plate 134 relative to the prop 12. In this manner, the moving piece 4 can be moved upwardly along the prop 12 from the fourth section 121 to the first section 124 to be transported to the passage space 211 on the top surface 124*a* of the prop 12 for downward sliding movement. After the moving piece 4 has been transported to the passage space 211, the track contacting portions 433, 423 of the moving piece 4 are capable of extending above an upper starting end of the track portion 23 for suspending the moving piece 4 on the track portion 23.

Figure 4:
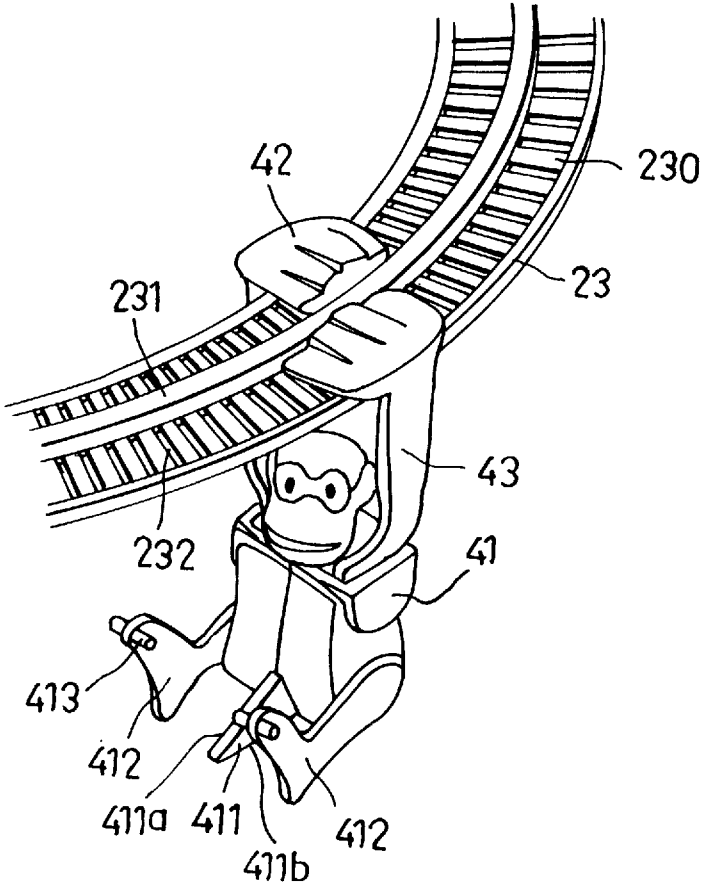

Since the track portion 23 curves downwardly, the moving piece 4 can move downwardly along the track portion 23. As shown in FIGS. 3 and 4, the elongated grooves 232 formed on the anti-slipping surface 230 generate friction with the track contacting parts 433, 423 of the left and right arms 43, 42 as the moving piece 4 slides downwardly along the track portion 23 to reduce downward moving speed of the left and right arms 43, 42 along the track portion 23 and to result in intermittent and alternating stopping of the left and right arms 43, 42 relative to the track portion 23, thereby causing the left and right arms 43, 42 to pivot relative to the body part 41 in an alternating fashion to give an effect of swinging movement of the moving piece 4 along the track portion 23. In particular, as shown in FIG. 3, when the right arms 42 stops on the track portion 23, the moving piece 4 pivots about the downward projection 424 which engages the elongated grooves 232 to permit sliding of the downward projection 434 on the left arm 43 along the track portion 23 for engagement with the elongated grooves 232 to stop the left arm 43. At this time, as shown in FIG. 4, the moving piece 4 pivots about the downward projection 434 to permit sliding of the downward projection 424 on the right arm 42 along the track portion 23 for engagement with the elongated grooves 232 further along the track portion 23.

Figure 6:
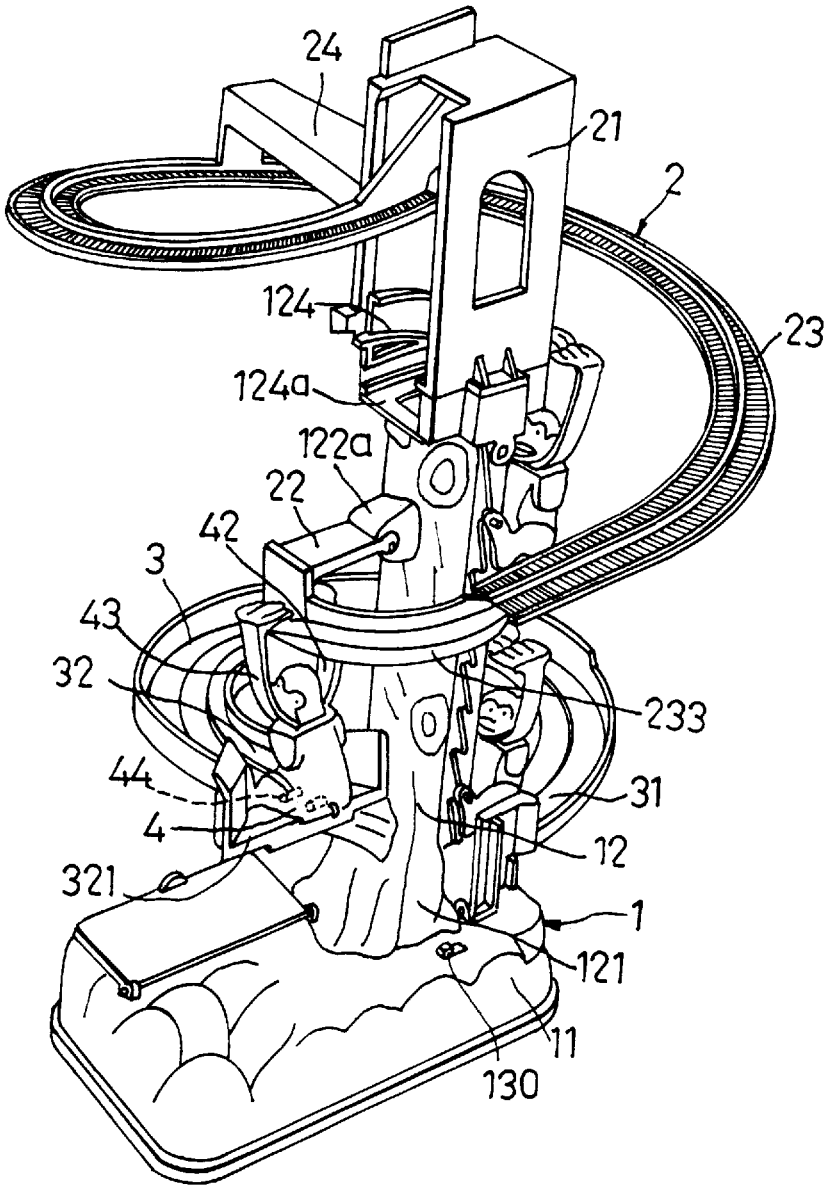
FIG. 6 is a perspective view of the toy of the preferred embodiment, illustrating the moving piece when being transferred from the suspending track member to a sliding track member.

Referring to FIG. 6, when the moving piece 4 reaches the smooth transfer section 233 of the track portion 23, the left and right arms 43, 42 are slidable therealong to a lower terminating end of the track portion 23. Thereafter, the left and right arms 43, 42 disengage the terminating end, and support for the weight of the moving piece 4 is transferred from the suspending track member 2 to the slide track member 3. The provision of the rollers 44 on the bottom side of the moving piece 4 help the moving piece 4 to slide smoothly along the slide track member 3 to reach the exit portion 31 for transporting the moving piece 4 upwardly along the prop 12 via the motor drive means 13.

It should be noted that the means provided on the base 1 for moving the moving piece 4 upwardly along the prop 12 from the fourth section 121 to the first section 124, which includes the drive plate 134, the motor drive means 13 and the guide teeth 125 formed on the outer surfaces of the prop 12, is not limited to the type employed in the preferred embodiment. Alternatively, the moving piece 4 can be brought manually from the fourth section 121 to the first section 124 by the user. Thus, the moving means is optional for the toy of the present invention. In addition, the slide track member 3 is also optional for the toy of the present invention. The mere provision of the suspending track member 2, which curves downwardly around the prop 12 and which has an anti-slipping top surface 230, is enough to result in the desired swinging effect of the monkey-shaped moving piece 4 along the track member 2.

With this invention thus explained, it is apparent that numerous modifications and variations can be made without departing from the scope and spirit of this invention. It is therefore intended that this invention be limited only as indicated in the appended claims.

We claim:

1. A toy comprising:

a base provided with an upright prop;

a suspending track member having a track portion that inclines gradually and downwardly and that has a top side formed with an anti-slipping surface;

a moving piece capable of downward sliding movement along said track portion, said moving piece including a body part and left and right arms, each of which has a lower section pivoted to said body part for forward and rearward pivoting movement of said left and right arms relative to said body part, and an upper section that extends from said lower section, said upper sections of said left and right arms being spaced apart by a distance wider than that width defined by said track portion such that said left and right arms are formed with a track contacting part that extends above said track portion for contacting said anti-slipping surface and for suspending said moving piece on said track portion;

said anti-slipping surface on said track portion generating friction with said track contacting parts of said left and right arms as said moving piece slides downwardly along said track portion to reduce downward moving speed of said left and right arms along said track portion and to result in intermittent and alternating stopping of said left and right arms relative to said track portion, thereby causing said left and right arms to pivot relative to said body part in an alternating fashion to give an effect of swinging movement of said moving piece along said track portion; and a slide track Member mounted on said prod below said suspending track member, said slide track member inclining gradually and downwardly, said body part of said moving piece engaging and sliding downwardly along said slide track member after said left and right arms disengage from a lower terminating end of said track portion.

2. The toy as claimed in claim 1, wherein said top side of said track portion is formed with a plurality of elongated grooves that extend along the width of said track portion to form said anti-slipping surface, said track contacting part of each of said left and right arms being formed with a downward projection for releasable engagement with said elongated grooves to reduce the downward moving speed of said left and right arms along said track portion.

3. The toy as claimed in claim 1, wherein said body part of said moving piece is hollow and has a horizontal pivot shaft mounted therein, said body part further having a top wall formed with a pair of openings to permit extension of said lower sections of said left and right arms respectively into said body part for mounting pivotally on said pivot shaft, said openings limiting range of forward and rearward pivoting movement of said left and right arms relative to said body part.

4. The toy as claimed in claim 1, wherein said track portion curves downwardly around said prop.

5. The toy as claimed in claim 4, further comprising means, provided on said base, for moving said body part of said moving piece along said prop from a lower end to an upper end of said suspending track member.

6. The toy as claimed in claim 4, wherein said slide track member inclines gradually downwardly and curving around said prop.

7. The toy as claimed in claim 6, wherein:

said prop has an upper first section, a second section disposed below said first section, a third section disposed below said second section, and a fourth section disposed below said third section;

said suspending track member further having a first mounting portion mounted on said first section and a second mounting portion mounted on said second section, said track portion being disposed between said first and second mounting portions;

said slide track member having an entrance portion mounted on said third section, an exit portion mounted on said fourth section, and a slide portion between said entrance and exit portions, said entrance portion being disposed below said second mounting portion of said suspending track member to transfer said moving piece from said suspending track member to said slide track member when said moving piece reaches said second mounting portion.

8. The toy as claimed in claim 7, wherein said entrance portion has a diverging entrance.

9. The toy as claimed in claim 7, further comprising means, provided on said base, for moving said body part of said moving piece from said fourth section to said first section of said prop.

10. The toy as claimed in claim 9, wherein:

said prop has one side facing said exit portion of said slide track member and formed with a longitudinally extending groove;

said body part of said moving piece being provided with a wedge projection that extends into said groove and that has an inclined upper edge and a lower edge;

said moving means including:

a drive plate disposed in said groove and movable upwardly and downwardly therein, said drive plate being formed with a plurality of vertically spaced rung projections that project in a direction of said one side of said prop, upward movement of said drive plate causing a lower one of said rung projections to support said lower edge of said wedge projection thereon so as to move said moving piece upwardly with said drive plate relative to said prop;

guide teeth formed along said prop such that adjacent guide teeth form a retaining notch therebetween, said moving piece being formed with an engaging pin that engages slidably said guide teeth such that upward movement of said moving piece with said drive plate causes said engaging pin to disengage a lower one of said retaining notches for movement to an upper one of said retaining notches;

downward movement of said drive plate causing an upper one of said rung projections to slide past said inclined upper edge of said wedge projection such that said moving piece is pushed in the direction of said one side of said prop to result in engagement between said engaging pin and said upper one of said retaining notches to retain releasably said moving piece on said prop and prevent downward movement of said moving piece with said drive plate relative to said prop; and motor drive means, mounted on said base and coupled to one end of said drive plate, for reciprocating linearly said drive plate in said groove.

* * * * *